US009694880B2

(12) United States Patent
Hanak

(10) Patent No.: US 9,694,880 B2
(45) Date of Patent: Jul. 4, 2017

(54) HANAK WATERCRAFT

(71) Applicant: Robert Eugene Hanak, Melbounre Beach, FL (US)

(72) Inventor: Robert Eugene Hanak, Melbounre Beach, FL (US)

(73) Assignee: Robert Eugene Hanak, Melb. Bea., FL (US)

( * ) Notice: Subject to any disclaimer, the term of this patent is extended or adjusted under 35 U.S.C. 154(b) by 0 days.

(21) Appl. No.: 14/322,365

(22) Filed: Jul. 2, 2014

(65) Prior Publication Data

US 2016/0001854 A1 Jan. 7, 2016

(51) Int. Cl.

| | |
|---|---|
| ***B63B 17/00*** | (2006.01) |
| ***B63B 35/79*** | (2006.01) |
| ***B63B 35/81*** | (2006.01) |
| ***B63B 35/71*** | (2006.01) |

(52) U.S. Cl.
CPC ..... *B63B 35/71* (2013.01); *B63B 35/79* (2013.01); *B63B 2035/715* (2013.01)

(58) Field of Classification Search
CPC ..... B63B 35/71; B63B 35/7906; B63B 2035/715; B63B 2029/043; B63B 35/79
USPC ..... 114/361; 441/74
See application file for complete search history.

(56) References Cited

U.S. PATENT DOCUMENTS 3,921,239 A * 11/1975 Sovia ..... B63B 35/81 280/18
4,660,490 A * 4/1987 Broadhurst ..... B63B 1/18 114/347
4,857,025 A * 8/1989 Brown ..... B63B 35/7906 441/65
6,035,799 A * 3/2000 Lukanovich ..... B63B 35/71 114/343

FOREIGN PATENT DOCUMENTS

AU WO 03024777 A1 * 3/2003 ..... B63B 25/002

* cited by examiner

*Primary Examiner* — Anthony Wiest

(57) ABSTRACT

A personal watercraft is designed to be ridden in a elevated seated position. The watercraft is generally shaped like a surfboard, including the nose, tail and fin or fins and includes a shaped raised seat and kick board to accommodate and conform to the riders body disposed in a seated position, so that the rider can propel and navigate the watercraft using a two bladed paddle like one for a kayak. The raised seat and backrest and wave spitting nosecone combination kick board is an ergonomically designed space for the rider's body to be seated on the top of the board in a seated position, creating a stable and dynamic platform for water exploits, With a higher the center of gravity, and allowing the rider to guide the craft with more leverage while riding braking waves by leaning in a desired direction.

1 Claim, 4 Drawing Sheets

HANAK WATERCRAFT

RELATED APPLICATIONS

This application claims priority to U.S. Provisional Patent Application Ser. No. 61/844,091

BACKGROUND

The present invention relates generally to single-person watercraft. More specifically, the present invention includes a watercraft designed to be ridden in the seated position on any body of water, including rivers, lakes, streams or oceans, wherein the rider's body is fully supported by, but not enclosed within the craft and the two bladed paddles are primarily used to power and direct the craft.

The "Hanak" watercraft paddles faster and is more maneuverable compared to a standup board. A rider can spend more time on the water because less effort is needed to paddle the watercraft and has a more comfortable position of the riders body. You can put the board in knee deep water to lift yourself easily into the seat with your arms to start off. A variety of size and shapes of surfboards will fit under the seat and kick board.

The rider interface on existing human powered watercraft has several advantages and disadvantages. Kayaks and canoes have the rider seated in a sitting position. This allows for increased torque with the use of a paddle. However, the seated position also raises the center of gravity, thereby increasing instability which is needed to ride braking waves.

Surfboards are made to be ridden on waves while standing and thus offer little stability in flat water or on rivers.

Body boards, or boogie boards, are designed to be ridden in the prone position, but such crafts typically extend only as far back as the pelvis, leaving the lower half of the rider's body exposed to rocks or other hazards below the surface of the water. There is also a substantial amount of drag created by the rider's legs being submerged in the water, creating a loss of speed, limiting directional control, and inhibiting response of the craft to the rider's propulsion. This arrangement limits their use in oceans or on rivers.

This present inventions design displaces water around the deck and past the rider without the water touching the rider body reducing drag from the body of the rider. Riding higher and dryer off the water you have less resistance from deck water. Being a foot off the water gives the rider greater leverage and body English to paddle and surf waves much like a standup paddle board paddle while surfing but, at a seated position. This elevated seat design lets you ride in a position that is more comfortable than low in the water like a Kayak which is at water level position.

People have used many means to navigate and explore bodies of water, such as canoes, kayaks, surfboards, and body boards. These specific crafts have been developed to facilitate travel on the many unique bodies of water found on the earth. Surfboards are primarily designed to ride wave momentum in ocean surf. Body boards are used in some rivers and in ocean surf.

This design presented has a single fin layout, but variety of fin layouts can be used are optional for various conditions or preferences can be used. The top deck design can be fitted to many different surfboard sizes bottom contours and shapes.

The craft may be manufactured using any suitable process. One such method includes the steps of filling a mold shaped like a surfboard The molded craft may then be fiber glassed over using fiberglass cloth, carbon fiber or Kevlar cloth with polyester and/or epoxy resin.

This embodiment allows for easy design changes. Other manufacturing processes may include rotational molding, flexible skin over a foam core, injection molding, blow molding, hand carved from foam and covered in a variety of composites, or any other suitable process to meet the design specifications and requirements that are described in this document.

It is particularly advantageous to manufacture the personal watercraft so that it has a monolithic design, without the need for multiple sections that must be snapped, glued, or otherwise attached together to form the final product. Such a monolithic design eliminates seams and connections that may tend to leak or come apart during the stress of use.

The most cost effective mode of manufacturing the craft would be to rotationally mold the craft, but techniques not yet applied to watercraft such as verity of foam cores with plastic skin, may yield a lighter and more cost effective craft. The method of a monolithic design crates a more durable and stable structure.

As mentioned heretofore, it should be understood that the watercraft may be used in any kind of water, including oceans, rivers, lakes, creeks.

SUMMARY OF THE INVENTION

A personal watercraft is designed to be ridden in a seated position. The elevated seat design puts the rider in a position that is more comfortable than the lower position in the watercraft like a kayak, which is at a water level position.

This design displaces water around the deck and past the rider without the water touching the rider's body reducing drag from the body of the rider.

Since the rider is elevated off the deck of the surfboard the rider has greater leverage to turn the watercraft on braking waves and greater leverage to paddle and surf waves much like a standup paddle board while surfing but, in a seated position. This position gives the rider more stable control while in ergonomic motion.

The wave splitting nosecone combination kick board for the feet of the rider allows the rider to apply greater leverage while turning the watercraft when surfing waves. The wave spitting nosecone combination displaces water around the deck and past the rider without the water touching the rider's body reducing drag from the body of the rider when paddling through on coming waves.

BRIEF DESCRIPTION OF THE DRAWINGS

These and other features, aspects, and advantages of the present invention will become better understood with regard to the following description, appended claims, and accompanying drawings where:

FIG. 1-4 is of one embodiment of a personal watercraft designed to be ridden in a seated position. This design has a single fin layout and a round pin tail, but variety of tail designs and fin layouts can be used. The top deck design can be fitted to many different surfboard sizes and shapes;

FIG. 1 Shows the location of leash attachment points on the nose and on the tail.

DETAILED DESCRIPTION OF THE INVENTION

The present invention includes a personal watercraft that is designed to be ridden in a seated position, as shown in FIGS. 1-4. (11) The craft is generally shaped like a surfboard or kayak.

The raised seat is shown in FIGS. 1-4. (12)

Figure 1:
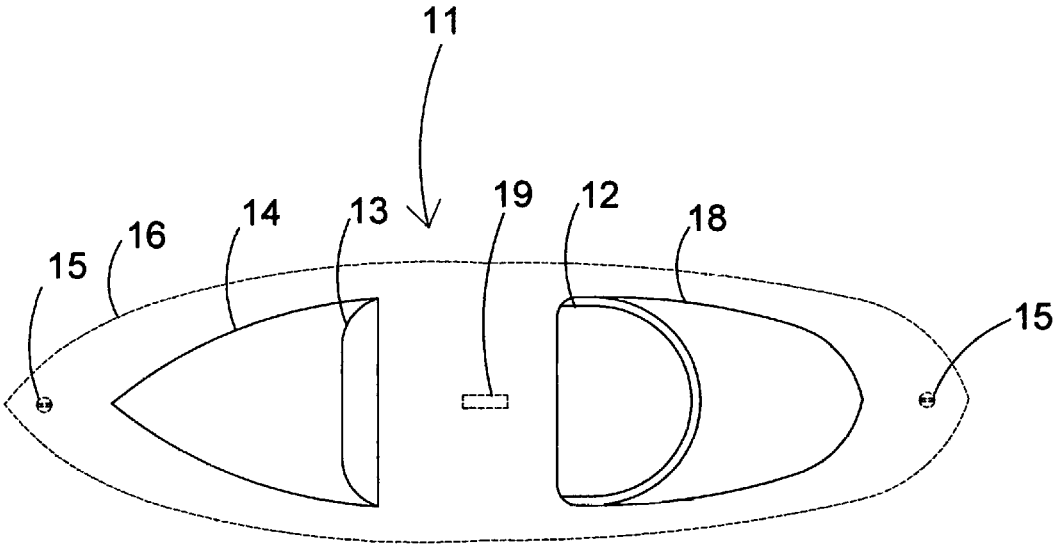
FIG. 1 is a top view of one embodiment of a personal watercraft designed to be ridden in a seated position.
Figure 2:
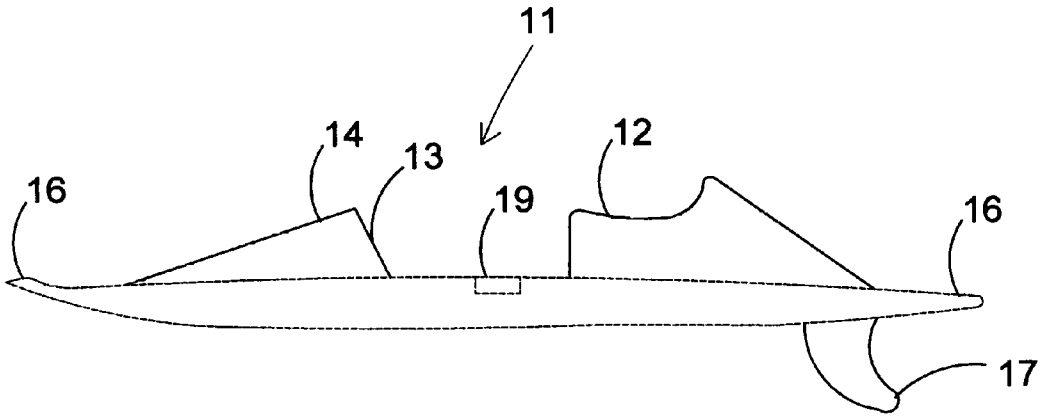
FIG. 2 is a right side view of one embodiment of a personal watercraft designed to be ridden in a seated position.
Figure 3:
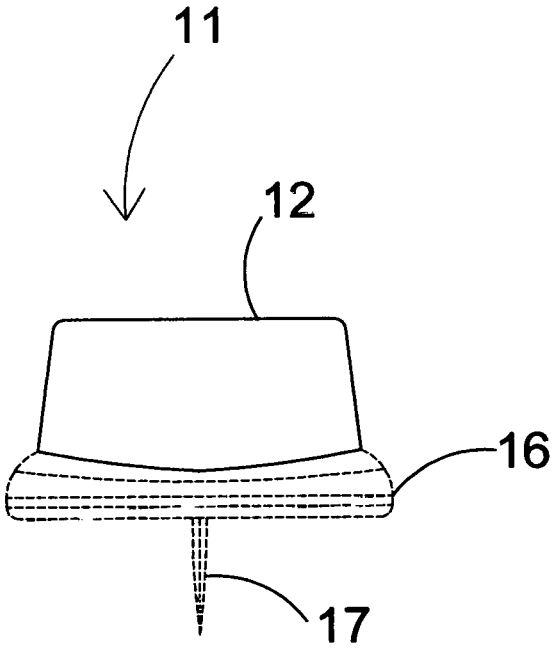
FIG. 3 is a tail view of one embodiment of a personal watercraft designed to be ridden in a seated position.
Figure 4:
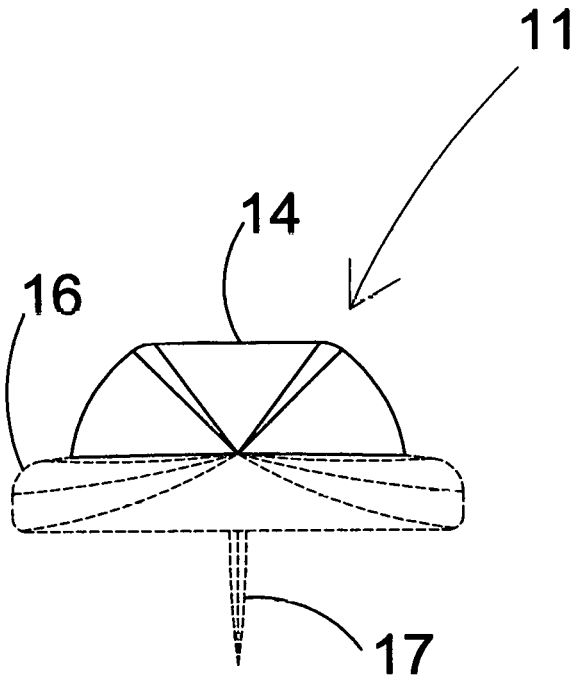
FIG. 4 is a nose view of one embodiment of a personal watercraft designed to be ridden in a seated position.

The kick board foot rest is shown in FIGS. 1, 2, 4 . . . (13)

The wave splitting nose cone is shown in FIGS. 1, 2, 4 (14)

The leash attachment points are shown in FIG. 1. (15)

The surfboard hull is shown in dashed lines to allow for different tail and nose shapes shown in FIG. 1-4. (16)

This design presented has a single fin layout (17), but variety of fin layouts can be used. The top deck design can be fitted to many different surfboard sizes bottom contours and shapes.

The seat support (18) is shown in FIG. 1.

The hand grip (19) location is at the balance point of the watercraft to aid in carrying the watercraft with one hand like a paddle board.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A watercraft comprising:

a surfboard hull, the surfboard hull including a deck which is a topside surface of the board where a surfer would ride to surf and lay to paddle, a bottom surface opposite the deck that primarily contacts the water, a tail at a back end of the surfboard having a slight upward rocker or curvature, a nose at a front end of the surfboard, said nose curved upward so that a tip of the nose is above a waterline, rails at each side edge of the surfboard extending from the tail to the nose where the deck and the bottom surface meet, an elevated seat and seat support located on an aft portion of the deck, the seat raised above the deck to elevate the center of gravity of the user, the seat support wider at a forward end and narrowing and sloping downward from the seat to meet the deck near the tail, an elevated wave splitting nosecone located above the waterline proximate the nose on a forward deck, the elevated wave splitting nose cone including a kick board foot rest, the elevated wave splitting nose cone is generally shaped as half cone with an apex of the cone proximate the tip of the nose and an opposite base of the half cone ending further aft near both rails, the kick board foot rest formed in the base of the half cone and angled forward from the deck, leash attachments located on the deck proximate the tail and nose, a hand grip centrally positioned near a center of the deck between the elevated seat and the kickboard foot rest for carrying the watercraft; and a fin or combination of fins located on the bottom of the surfboard hull near the tail.

* * * * *